United States Patent [19]

Briggs, Sr. Kenneth W.

[11] Patent Number: 4,887,391

[45] Date of Patent: Dec. 19, 1989

[54] WINDOW SHUTTER ASSEMBLY AND METHOD OF PRODUCTION

[75] Inventor: Briggs, Sr. Kenneth W., Rice, Tex.

[73] Assignee: Rushman Draperies, Inc., Dallas, Tex.

[21] Appl. No.: 58,146

[22] Filed: Jun. 4, 1987

[51] Int. Cl.[4] ..... E06B 7/086

[52] U.S. Cl. ..... 49/90; 49/74

[58] Field of Search ..... 49/90, 74, 64, 88, 87; 98/121.2

[56] References Cited

U.S. PATENT DOCUMENTS

| | | | |
|---|---|---|---|
| 118,454 | 8/1871 | Hobbs | 49/90 |
| 169,644 | 11/1875 | Johnston et al. | 40/90 X |
| 207,026 | 8/1878 | Fuller | 49/90 X |
| 213,343 | 3/1879 | Morstatt | 49/88 |
| 345,689 | 7/1886 | Hayes | 49/121.2 X |
| 360,058 | 3/1887 | Snell et al. | 49/90 X |
| 368,808 | 8/1887 | Cahill | 49/88 |
| 3,129,471 | 4/1964 | Johnson et al. | 49/64 |
| 3,153,819 | 10/1964 | Bond | 49/64 |
| 3,292,309 | 12/1966 | Horner | 49/64 |

*Primary Examiner*—Philip C. Kannan

*Attorney, Agent, or Firm*—Ross, Howison, Clapp & Korn

[57] ABSTRACT

A window shutter having pivoting louvers mounted in a rectangular shutter frame and linked together for common pivotal movement by a ganging bar mounted adjacent the ends of the louvers. The bar has pins extending into the end of each louver spaced from the pivot point of the louver. The louvers are retained in positions selected by the user without imposing significant axial force on the louvers by means of a pair of magnets mounted in the side of the frame adjacent the ganging bar for retaining the bar in the selected position. The shutter assembly is formed by production and finishing of the rectangular frame separately from production and finishing of the louvers, and then mounting louvers in the frame while simultaneously mounting the ganging bar.

6 Claims, 1 Drawing Sheet

FIG. 1
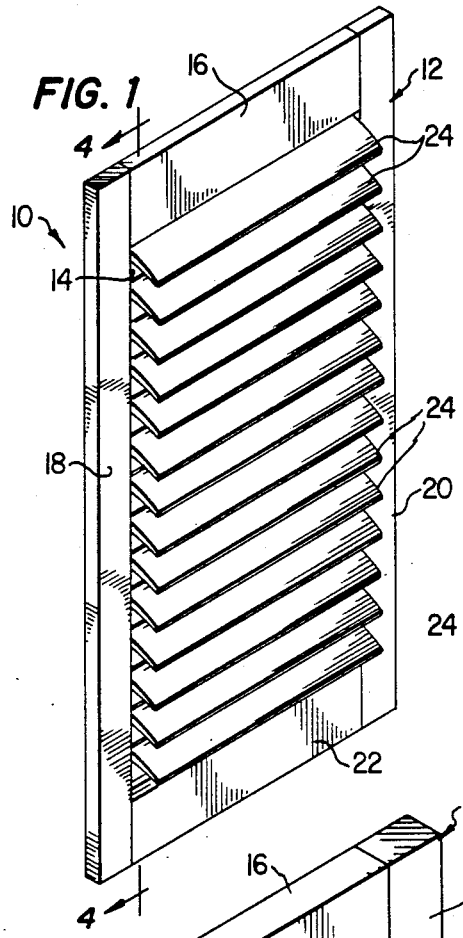
FIG. 2
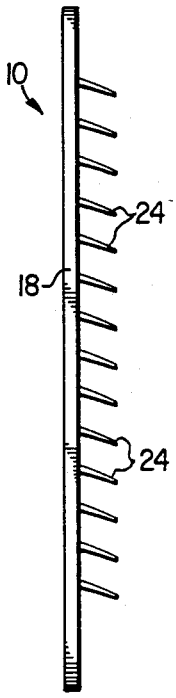
FIG. 3
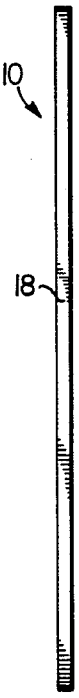
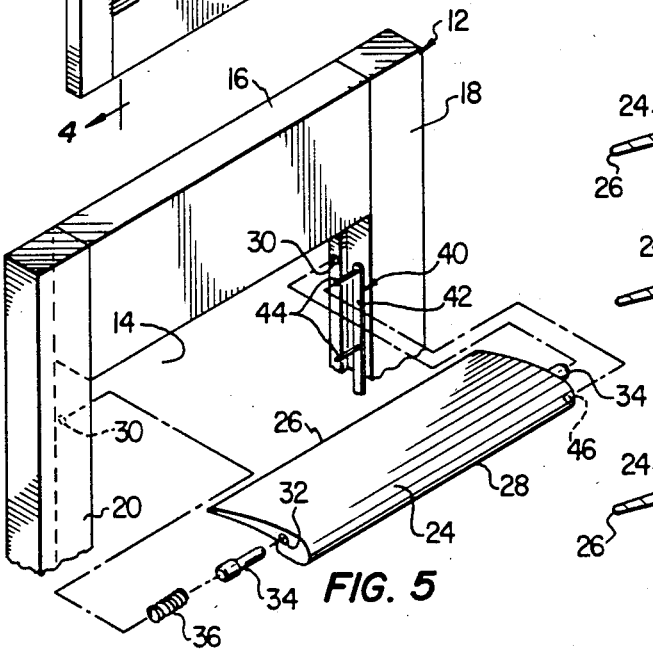
FIG. 5
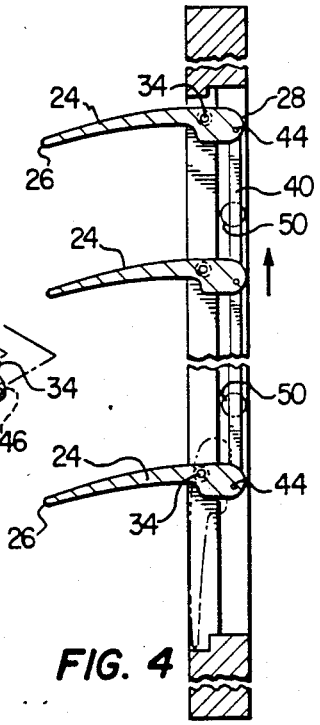
FIG. 4

WINDOW SHUTTER ASSEMBLY AND METHOD OF PRODUCTION

TECHNICAL FIELD

The technical field of this invention relates to window shutters, and more particularly to shutters which employ a plurality of adjustable louvers pivoted in a frame for common movement.

BACKGROUND ART

Window shutters employing pivoting louvers for selection of the amount of light admitted thereby are well known in the art. Typical decorative window shutters have movable louvers ganged together for common movement by a rod or stick mounted down the center of the shutter assembly and secured by means of staples or other fasteners to the edge of each louver. This arrangement, which is standard in the louvered shutters available, interferes with the field of view through the shutters when the shutters are open, and presents problems for cleaning and painting of the shutter assembly. It also involves relatively labor intensive, and thus expensive, assembly procedures since the arrangement requires that individual staples or fasteners be mounted in the edge of each louver and fastening means be secured to the stick for engaging each louver staple.

In the typical shutters of the prior art, the means provided to releasably retain the louvers in a rotational position selected by the user is a heavy spring loading at either or both ends of each louver to maintain axial tension on the louver. The movement action of the shutter assembly is somewhat jerky because of this axial tension.

The usual manufacturing procedure for louvered shutter assemblies is to bring together each of the side, top and bottom pieces for the rectangular frame to be formed as well as each of the plurality of louvers, which are then combined in one step. While this assembly might though to be efficient, the manufacturing procedures which are required in addition to this step are relatively inefficient and expensive. The fastening means for each louver must be applied to the edge of each louver in a separate process, and corresponding fastening means be applied to the ganging rod for mating with the louver edge fasteners. Moreover, the whole assembly must be finished by painting or the like after the single step formation of frame with mounted louvers.

Typical examples of the arrangement of shutter assemblies wherein louvers are ganged together by a central stick or rod are shown in U.S. Pat. Nos. 2,718,485 and 2,761,185.

SUMMARY OF THE INVENTION

In accordance with the invention, there is provided a window shutter assembly comprising a frame having a rectangular opening between inwardly facing first and second side faces and a plurality of spaced elongate louvers extending between the side faces, each mounted for pivotal movement with respect to the frame about a horizontal axis. Ganging means which link the plurality of louvers for common pivotal movement are mounted adjacent one of the side faces. Position retaining means associated with the ganging means and located adjacent the end of the louvers hold the louvers in the pivotal orientation to which the user sets them. In a specific embodiment, the position retaining means impose substantially no axial force on the louvers.

In a further aspect of the invention, the louvers and their points of pivot are arranged so that the axis about which each louver pivots is spaced at least as far from the rear face of the frame as the distance from the axis to the rear edge of the louver so that the louvers never extend in their pivotal travel beyond the plane of the rear face of the frame.

In a specific aspect of the invention, ganging of the louvers for common pivotal movement is accomplished by means of a thin ganging bar positioned slidably against one of the side faces of the rectangular frame which is provided with a plurality of upstanding ganging pins, each of which extends horizontally into the end of the louver at a point spaced from the axis of pivot of the louver. Retaining means are provided for the ganging bar by one or more magnets affixed in the side face of the frame adjacent the ganging bar for retaining the ganging bar in any selected position.

In accordance with the manufacturing method of this invention, the frame is formed into its completed state and a selected finish is applied thereto separately from the louvers which are also finished separately. The louvers are then mounted in the frame while simultaneously installing ganging means adjacent the ends of the louvers.

DESCRIPTION OF THE DRAWINGS

FIG. 1 is a front perspective view of a window shutter constructed in accordance with the invention;

FIG. 2 is a side view of the shutter depicted in FIG. 1, with the louvers open;

FIG. 3 is a side view similar to FIG. 2 with the louvers closed;

FIG. 4 is a sectional view taken along the line 4—4 in FIG. 1; and

FIG. 5 is a partial rear perspective of the shutters of FIG. 1 with the parts exploded to illustrate the elements combined in accordance with the method of manufacture of the invention.

DETAILED DESCRIPTION

A shutter assembly 10 constructed in accordance with the invention is depicted in the drawings. The shutter 10 utilizes a frame 12, preferably formed from wood, to form a rectangular opening 14. Frame 12 is formed by joining top panel 16, left panel 18, right panel 20 and bottom panel 22. A plurality of louvers 24 span rectangular opening 14 between the inward side faces of panels 18 and 20. Each louver 24 has a leading edge 26 and a trailing edge 28.

Side panels 18 and 20 are provided with a pair of horizontally aligned mounting holes 30 for each louver 24. The louvers 24 are provided with mounting holes 32 near the trailing edge 28 for receiving conventional nylon mounting pins 34 which snugly engage the louver holes 32 to position the louver 24 horizontally by the reception of pins 34 in frame holes 30. A mounting spring 36 is provided in between pin 34 and mounting hole 30 adjacent side panel 20, so that the pins 34 at that end may be depressed to accomplish insertion of the louvers 24 into the frame 12. Spring 36 is compressible so that the adjacent pin 34 may be depressed away from louver 24. Once the louvers 24 are in position, springs 36 are no longer in compression, and exert substantially no axial force in the completed assembly 10. The holes 32 in the ends of louver 24 are positioned so that the distance from holes 32 to the trailing edge 28 of the louvers is less than the horizontal distance from frame mounting holes 30 to the back face of frame 12.

A ganging bar 40 has a flat web portion 42 and a series of protruding pins 44, and is mounted flat with the inward side face of frame panel 18, extending the vertical length of the opening 14. The ends of louvers 24 adjacent side panel member 18 are each provided with a second hole 46 for receiving the ganging bar pins 44, which holes 46 are spaced from the axis of frame mounting holes 30.

A pair of magnets 50 are mounted flush with the inwardly facing side face of panel 18 adjacent the ganging bar 40.

The assembly is preferably produced by joining panels 16, 18, 20 and 22 to form frame 12. Frame 12 may then be finished by painting or applying other coating material. Louvers 24 are likewise finished by painting in any selected color or series of colors prior to mounting in frame 12. Following the formation in prefinishing steps of each of the frame 12 and louvers 24, the louvers may be simultaneously mounted with ganging bar 40 into the operative position depicted. Because manufacturing tolerances require that the holes be larger than the ganging bar pins 44, the mounting step should be preceded by inserting glue, such as an epoxy resin glue or hot glue, in the holes 46 to prevent "play" in the louvers. After the glue has set, the louvers 44 may be rotated to break the metal pins 44 free from the glue whereafter they are free to turn in the holes 46.

In operation, the louvers may be rotated on their pivot pins 34 by smooth and simple manual action applied to a single louver 24. The ganging bar 40 causes all louvers to move in common and substantially parallel relationship. Throughout their entire pivotal movement, louvers 24 do not extend so far rearwardly that their trailing edges 28 extend beyond the rear face of the frame 12, as shown in FIG. 4. Once the user has moved the louvers 24 to a selected position, magnets 50 acting upon ganging bar 40 serves to retain the preferred position without placing axial stresses on the louvers 24.

As will be seen from the foregoing description and drawings, the resulting shutter assembly is one with substantial advantages over presently available shutters. The ganging bar is essentially flush at the side of the frame, so that it does not interfere with sightlines, or with cleaning or painting the shutter assembly 10. The assembly procedure is simplified and made less expensive.

A smoothly operating shutter is provided without the necessity of separately securing fasteners to the shutter louvers to a ganging rod or stick. Because the components are preformed and prefinished prior to assembly, the louvers may be finished in any selected manner desired by the user. For example, the louvers may actually vary in color one from the other, so that spectrums of color may be produced. As one example, a common color may be shaded in intensity or hue as one proceeds from one louver to louver, accomplishing a pleasing aesthetic effect, which would not be possible using conventional shutter assembly manufacturing techiques. The louvers are mounted in the frame in such a way that the trailing edges of the louvers never extend beyond the rear face of the frame, simplifying installation of the shutter in many instances.

Although specific embodiments of the invention have been illustrated in the accompanying drawings and described in the foregoing detailed description, it will be understood that the invention is not limited to the embodiments disclosed, but is capable of numerous rearrangements, modifications and substitutions of parts and elements without departing from the spirit of the invention.

I claim:

1. A window shutter comprising:

(a) an open frame having a rectangular opening between inwardly facing first and second side faces, the first side face having at least one magnet-receiving recess formed thereon;

(b) a plurality of spaced elongate louvers extending substantially the entire distance between the side faces, each substantially identically mounted for pivotal movement with respect to the frame about a horizontal axis without horizontal movement;

(c) ganging means located adjacent the first side face linking the plurality of louvers for common pivotal movements, said ganging means including a flat metallic bar lying slidably against the first side face, and pin portions extending into the ends of the louvers from the bar;

(d) position retaining means comprising at least one magnet mounted in the magnet receiving recess of the frame flush with the first side face and adjacent the metallic bar of the ganging means so that the bar slidingly confronts the magnet and the magnet serves to directly constrain the bar from unintended movement while permitting intended adjustment of the pivotal orientation of the louvers.

2. A window shutter comprising:

(a) a frame having a rectangular opening between inwardly facing first and second side faces;

(b) a plurality of spaced elongate louvers extending substantially the entire distance between the side faces, each mounted for pivotal movement with respect to the side faces through a continuous range of positions about a horizontal axis;

(c) ganging means linking the plurality of louvers for common pivotal movement; and (d) position retaining means associated with the ganging means for holding the louvers in any pivotal orientation to which a user sets them in the continuous range of positions, said position retaining means imposing substantially no axial force on any of the louvers.

3. The shutter of claim 2, in which the ganging means includes a first web portion lying flat against the first side face, and second pin portions extending into the ends of the louvers.

4. The shutter of claim 3, wherein the position retaining means comprises at least one magnet mounted flush with the first side face adjacent the first web portion of the ganging means.

5. A louvered window shutter comprising:

(a) a frame having a rectangular opening between inwardly facing first and second side faces, the front face of the frame about the rectangular opening being substantially planar and substantially free of projecting mechanisms for louver operation;

(b) a plurality of spaced elongate louvers extending between the side faces and mounted for pivotal movement with respect to the side faces over a continuous series of positions about horizontal axes;

(c) a thin ganging bar positioned slidably against the first side rearwardly of said horizontal axes and having a plurality of ganging pins, each pin extending horizontally into the end of a louver at a point spaced from the axis of the pivot of the louver; and (d) position retaining means for holding the louvers in any selected position of the continuous series of positions.

6. A window shutter comprising:

(a) a frame having a rectangular opening between inwardly facing first and second side faces;

(b) a plurality of spaced elongate louvers extending between the side faces and mounted for pivotal movement with respect to the side faces about horizontal axes;

(c) a thin ganging bar positioned slidably flat against the first side face and having a plurality of ganging pins, each pin extending horizontally into the end of a louver at a point spaced from the axis of pivot of the louver; and (d) magnet means fixed in the frame flush with the first side face adjacent the ganging bar for retaining the ganging bar in any selected position in the continuous series of positions defined by the pivotal movement of the louvers.

* * * * *